US008561719B1

(12) United States Patent
Shoaf

(10) Patent No.: US 8,561,719 B1
(45) Date of Patent: Oct. 22, 2013

(54) COMPUTERIZED BORING SYSTEM WITH BORE HEAD SENSORS

(76) Inventor: William Robert Shoaf, Medford Lakes, NJ (US)

( * ) Notice: Subject to any disclaimer, the term of this patent is extended or adjusted under 35 U.S.C. 154(b) by 388 days.

(21) Appl. No.: 13/011,874

(22) Filed: Jan. 22, 2011

(51) Int. Cl.
*E21B 44/00* (2006.01)

(52) U.S. Cl.
USPC ..... 175/24; 175/61; 175/62; 324/326

(58) Field of Classification Search
USPC ..... 175/24, 26, 61, 62; 324/326
See application file for complete search history.

(56) References Cited

U.S. PATENT DOCUMENTS

| | | | | |
|---|---|---|---|---|
| 3,746,106 | A | 7/1973 | McCullough et al. | |
| 5,363,926 | A | 11/1994 | Mizuno | |
| 5,457,995 | A | 10/1995 | Staton et al. | |
| 5,767,678 | A | 6/1998 | Mercer | |
| 7,218,116 | B2 | 5/2007 | Brune et al. | |
| 7,347,280 | B2 | 3/2008 | Brune et al. | |
| 7,404,456 | B2 | 7/2008 | Weaver et al. | |
| 7,735,579 | B2 | 6/2010 | Gopalan et al. | |
| 2003/0056983 | A1 * | 3/2003 | Alft et al. | 175/19 |
| 2009/0008151 | A1 * | 1/2009 | Turner et al. | 175/45 |

FOREIGN PATENT DOCUMENTS

| | | |
|---|---|---|
| JP | 8029247 | 2/1996 |

* cited by examiner

*Primary Examiner* — Brad Harcourt
(74) *Attorney, Agent, or Firm* — Michael I. Kroll

(57) ABSTRACT

A computerized boring system provides real-time monitoring and control of a bore head during boring operations to prevent inadvertent damage to buried objects such as utility cables. A boring machine with a shaft, a bore head on an end of the shaft, and one or more proximity sensors for detecting underground target objects is controlled manually and by a computer control system in communication with the sensors, a programmable logic computer and/or electrical relay system providing control of rotational and longitudinal movement of the bore head in response to data generated by the sensors.

18 Claims, 12 Drawing Sheets

COMPUTERIZED BORING SYSTEM WITH BORE HEAD SENSORS

BACKGROUND OF THE INVENTION

1. Field of the Invention

The present invention relates generally to drilling and, more specifically, to a computerized boring system that provides real time feedback to a computer control system that reduces the chance of the boring operation causing damage to a buried utility or structure. There can be one to several proximity sensors embedded in the bore head that detect buried facilities. Sensors can be arranged within the bore head in any configuration including vertically, horizontally, and at any angle in between. The number of sensors in the bore head depends on the bore head size and sensing resolution required for boring operations. The computer control system preferably incorporates at least one programmable logic controller (PLC) and/or an electrical relay system in communication with said number of bore head sensors.

The application illustrates a specific embodiment of the invention, which is not intended to limit the invention in any manner.

2. Description of the Prior Art

There are other boring machines which provide for bore head location. While these boring machines may be suitable for the purposes for which they where designed, they would not be as suitable for the purposes of the present invention as heretofore described.

It is thus desirable to provide a computerized boring system having sensor elements within the bore head to detect buried metallic utilities prior to contact by the bore head.

It is further desirable to provide computational analysis of the sensor data to control the rotational and vertical speed of the boring operation and location of the bore head relative to top dead center of the pipe.

SUMMARY OF THE PRESENT INVENTION

The present invention comprises a computerized boring system having a boring machine that provides real time feedback to a computer control system that reduces the chance of the boring operation causing damage to a buried utility or structure. There can be one to several proximity sensors embedded in the bore head that detect buried facilities. Sensors can be arranged within the bore head in any configuration including vertically, horizontally, and at some angle in between. The number of sensors in the bore head depends on bore head size and resolution of sensing needed for boring operations.

In addition to proximity sensors in the bore head, there will also be a linear position sensor on the boring machine to provide real time information to the computer of linear movement of the boring mechanism. This linear movement is used to determine total movement of the bore head and to calculate linear velocity of the bore head.

Preferably a programmable logic computer (PLC) is used to control the boring process but is not limited to such and may be controlled by an electrical relay system in addition to and in place of the PLC. The PLC takes inputs from the bore head sensors in an analog and discrete way. The analog signals come as a variable range (often 4 to 20 mA) that is directly proportional to distance of the proximity sensor from the target object.

The different models of the sensors can also send an on or off signal telling of the presence or lack thereof of a target object. Both types of inputs to the PLC from the bore head proximity sensors can be implemented in any combination. The PLC also takes an analog signal from the linear position indicator which is proportional to distance of movement of this sensor which is directly connected to the boring machine.

Another signal is monitored by the PLC giving real time rotational position and velocity of the boring column, or shaft. This is accomplished by one or more of several methods. One method is an analog proximity sensor measuring distance between the sensor and an outer surface of a collar affixed circumferentially on the boring machine shaft. This collar is of a circumferentially variable width that starts at a set thickness and changes thickness, either thicker of thinner, throughout its circumference. This difference in thickness can be correlated into a rotational position and a rotational velocity by the PLC. A notched collar or some type of segmented offset difference between the sensor and shaft can also be used to send pulses to the PLC that can be correlated to a rotational position and a rotational velocity.

Pressure of the boring machine's hydraulic system might also be monitored by the PLC. The boring machine's hydraulic system may be monitored in two ways. First being pressure of the hydraulics providing upward or downward force of the bore head. Also, pressure of the hydraulic system providing rotational motion to the bore head. These pressures may be monitored by use of pressure transducers providing an analog output to the PLC.

To control boring linear and rotational motion, the PLC will send output signals to separate electro-hydraulic valves in the boring machine's hydraulic system that will open fully or partially and close as needed to keep the bore head within needed parameters. These electro-hydraulic valves are located in parallel configuration to the manual controls for the boring machine to allow for either manual or automatic control of the boring process. Feedback from the actual position of the electro-hydraulic valves will be sent to the PLC in the form of an analog or digital signal to give an indication if the valves are operating as desired by the PLC.

The automatic control of boring will be used to provide nearly instantaneous response to buried objects detected in or near the desired boring path.

When the automated boring process is initiated by the machine operator by pushing a button providing input to the PLC triggering the automated boring routine, the boring machine will begin to rotate the bore head at a set speed and then begin to move the bore head into the ground at a set downward velocity.

The PLC will control the rotational and linear movement to ensure the bore head does not travel downward at a greater speed than the distance able to be sensed by the bore head sensors per revolution of the bore head. For example, if the bore head sensor can sense an object up to ½" inch away from the bore head, then the bore head will not be allowed to move downward further than ½" before another sensor in the bore head passes the same area. With one sensor in the head, the boring machine will not push the head more than ½" per revolution. With two sensors in the bore head, the PLC would limit downward movement to ½" per ½ revolution.

Once the bore head senses a buried target, the boring machine will stop rotation and downward movement and await input from the machine operator on the next operation to perform. If the depth traveled downward is not what is expected to find the target, for example, a pipeline, then the machine operator will likely manually pull the bore head back to the surface and determine if a new location is required to bore to the intended target or pipeline.

If the bore head has traveled the expected downward distance to the target or pipeline of interest, then the machine operator will push a certain button providing an input to the PLC for the circumferential position sensing automated routine to run. The PLC will then rotate the bore head and identify the closest location between the bore head and buried target by way of a vertical, horizontal or angled at 45 degrees sensor. If the closest proximity sensor to the buried target is the vertical sensor, then the bore head has encountered the pipe on or very near the top.

If the horizontal sensor is the closest proximity sensor to the pipe, then the bore head has encountered the side of pipe at or near the 3:00 or 9:00 position. If the closest proximity sensor to the buried target is the angled sensor at 45 degrees from vertical, then the pipe has been encountered somewhere between 12:00 and 3:00 or 9:00 and 12:00 on the top half of the pipeline.

In the case of the angled sensor being the closest proximity sensor to the pipe, and the buried target not be at ½ or less of the maximum sensing distance, the PLC will rotate the bore head at normal boring speed and begin to apply downward pressure measuring the amount of downward displacement and sensor distance to the buried target until the bore head is within ½ the maximum sensing distance and will immediately stop all downward motion and will align the bore head sensor at its closest position to the intended target.

Next the PLC will begin to pull the bore head upward slowly and will measure the difference between upward distance and distance from the pipe measured with a bore head sensor at a 45 degree angle to vertical. Calculations will be performed in the PLC using trigonometry to give a measurement in degrees circumferentially off top of pipe.

It is possible that all signals to the PLC could be in the form of a digital signal by one or more forms of communications path other than the currently conventional analog or discrete method.

A primary object of the present invention is to provide a computerized boring system utilizing a boring machine enabled to identify underground objects and to calculate and display the position of the bore head sensor(s) relative to the underground object.

Another object of the present invention is to provide a computerized boring system enabled to prevent inadvertent boring of underground structures by sensing their presence and communicating their location.

Yet another object of the present invention is to provide a boring machine bore head enabled to cease boring at a specified distance from an underground object, preferably ½ the sensor range.

An additional object of the present invention is to provide a computerized boring system having an interactive control for executing a boring operation cycle.

A further object of the present invention is to provide a computerized boring system having bore head sensor data responsive computer control during a boring operation cycle.

A yet further object of the present invention is to provide a computerized boring system wherein the computer control incorporates computational analysis software for determining bore head position relative to a target's, for example, a conduit's, top dead center position.

A yet further object of the present invention is to provide a computerized boring system wherein the computer control system preferably incorporates at least one programmable logic controller (PLC) and/or an electrical relay system.

Additional objects of the present invention will appear as the description proceeds.

The present invention overcomes the shortcomings of the prior art by providing a computerized boring system having a boring machine that provides real time feedback to a computer control system that reduces the chance of the boring operation causing damage to a buried utility or structure. There can be one or more proximity sensors embedded in the bore head that detect buried facilities. Sensors can be arranged within the bore head in any configuration including vertically, horizontally, and at any desired angle in between. The number of sensors in the bore head can depend on bore head size and desired resolution of sensing as needed for boring operations.

The foregoing and other objects and advantages will appear from the description to follow. In the description reference is made to the accompanying drawing figures, which form a part hereof, and in which is shown by way of illustration specific embodiments by which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DESCRIPTION OF THE REFERENCED NUMERALS

Figure 1:
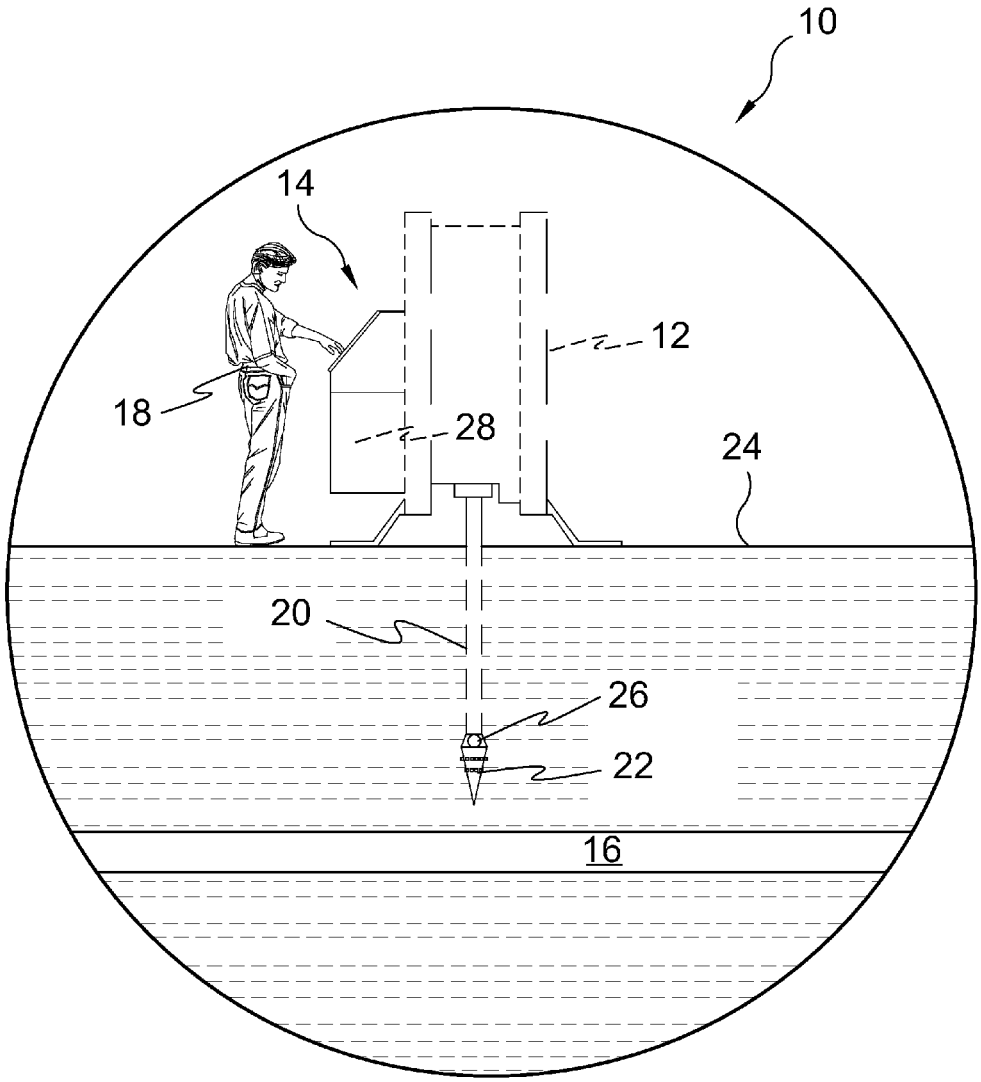
FIG. 1 is an illustrated view of the present invention in use.

Turning now descriptively to the drawing figures, in which similar reference characters denote similar elements throughout the several views, the figures illustrate the Computerized Boring System of the present invention. With regard to the reference numerals used, the following numbering is used throughout the various drawing figures.

10 computerized boring system of the present invention
12 boring machine
14 computer control system
16 underground target object
18 machine operator

20 shaft of 12
22 bore head on end of 20
24 ground surface
26 bore head proximity sensor(s)
28 programmable logic computer
30 linear position sensor
32 drills on 22
34 initiating the automatic boring process
36 boring machine begins rotation of the bore head
38 boring machine penetrates ground at a predetermined velocity
40 bore head senses a buried target
42 boring machine stops rotation and downward movement, waiting for input from the machine operator for the next move to perform
44 machine operator then provides input to the programmable logic computer for circumferential position, sensing an automatic routine to run
46 programmable logic computer rotates the bore head and identifies the closest location between the bore head and a buried target object with one of the vertical, horizontal or angled at 45 degrees proximity sensors
48 position of the closest sensor to the target
50 vertical sensor
52 bore head encounters target on or very near top dead center, or 12:00 position, of target
54 horizontal sensor
56 bore head encounters target on or very near one of two sides of the target, near 3:00 or 9:00 positions
58 angled sensor
60 bore head encounters top half of target between about 9:00 position and 3:00 position of target
62 If angled sensor is sensor closest to target, and target is further than ½ sensor range distant from sensor, PLC will rotate bore head at normal rotating speed while applying downward pressure, measuring amount of downward displacement and sensor distance to target until sensor is within ½ sensor range at which point PLC immediately stops downward motion to align bore head sensor at closest position to target
64 PLC begins to pull bore head upward slowly, while measuring difference between upward distance and distance from target, measured with angled bore head sensor
66 PLC performs calculations using trigonometry to give measurement in degrees circumferentially off top of target
68 PLC controls the boring process
70 boring machine
72 vertical, horizontal and angled sensors in the boring head
74 linear position sensor
76 linear movement (including velocity) of the boring head
78 PLC
80 receive input from the boring head sensors
82 distance from the sensor of a detected target
84 absence of a target
86 analog proximity sensor
88 measure distance between proximity sensor and outer surface of collar
90 variable thickness of the collar produces pulses
92 pulses correlatable by programmable logic computer into rotational position and rotational velocity of shaft
94 segmented offset difference between sensor and shaft
96 sensor sends pulses to PLC which correlates pulses to rotational position and rotational velocity
98 PLC monitoring
100 pressure transducers provide analog output to PLC
102 pressure of the boring machine hydraulic systems
104 longitudinal hydraulic system providing upward and downward force to shaft
106 rotational hydraulic system providing rotational motion to bore head
108 PLC
110 boring machine hydraulic system electro-hydraulic valves
112 keep bore head operating within desired parameters
114 fully open position
116 partially open position
118 fully closed position
120 feedback signal provides PLC actual position of electro-hydraulic valves in an analog or digital signal
122 boring process
124 manual control
126 automatic control

DETAILED DESCRIPTION OF THE PREFERRED EMBODIMENT

The following discussion describes in detail one or more embodiments of the invention. This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the present invention in use. The present invention is a computerized boring system 10 which employs a boring machine 12 that provides real time feedback to a computer control system 14 that reduces the chance of the boring operation causing inadvertent damage to an underground target object 16, for example, a utility structure, by providing boring operations data to the machine operator 18. Shown is the computerized boring system 10 of the invention comprising a boring machine 12 having a shaft 20 with a bore head 22 on an end of the shaft 20, the bore head used to bore into a ground surface 24. One or more proximity sensors 26 in the bore head 22 allow for detecting the proximity of underground target objects 16, within sensor range. The boring machine 12 is controlled both manually by a machine operator 18, through an interactive control for executing a boring operation cycle, and automatically through a computer control system 14 in communication with the proximity sensors 26, the computer control system 14 having a programmable logic computer 28 for controlling the rotational and longitudinal movement of the bore head 22 in response to the data provided to the computer control system 14 by the proximity sensors 26. Preferably, the proximity sensors 26 are metal detecting proximity sensors.

Proximity signals are generated by one or more sensors 26 within the bore head 20 that are used to detect buried objects 16 such as utility cables prior to contact by the bore head 20. The one or more proximity sensors 26 can be positioned in a multitude of configurations including vertical, horizontal and at any angle therebetween. The number of bore head sensors is dependent on the bore head size and resolution of sensing needed for boring operations. Additionally, in a preferred embodiment of the invention, the programmable logic computer 28 is capable of calculating and displaying the position of the proximity sensor 26 relative to the target object 16.

Figure 2:
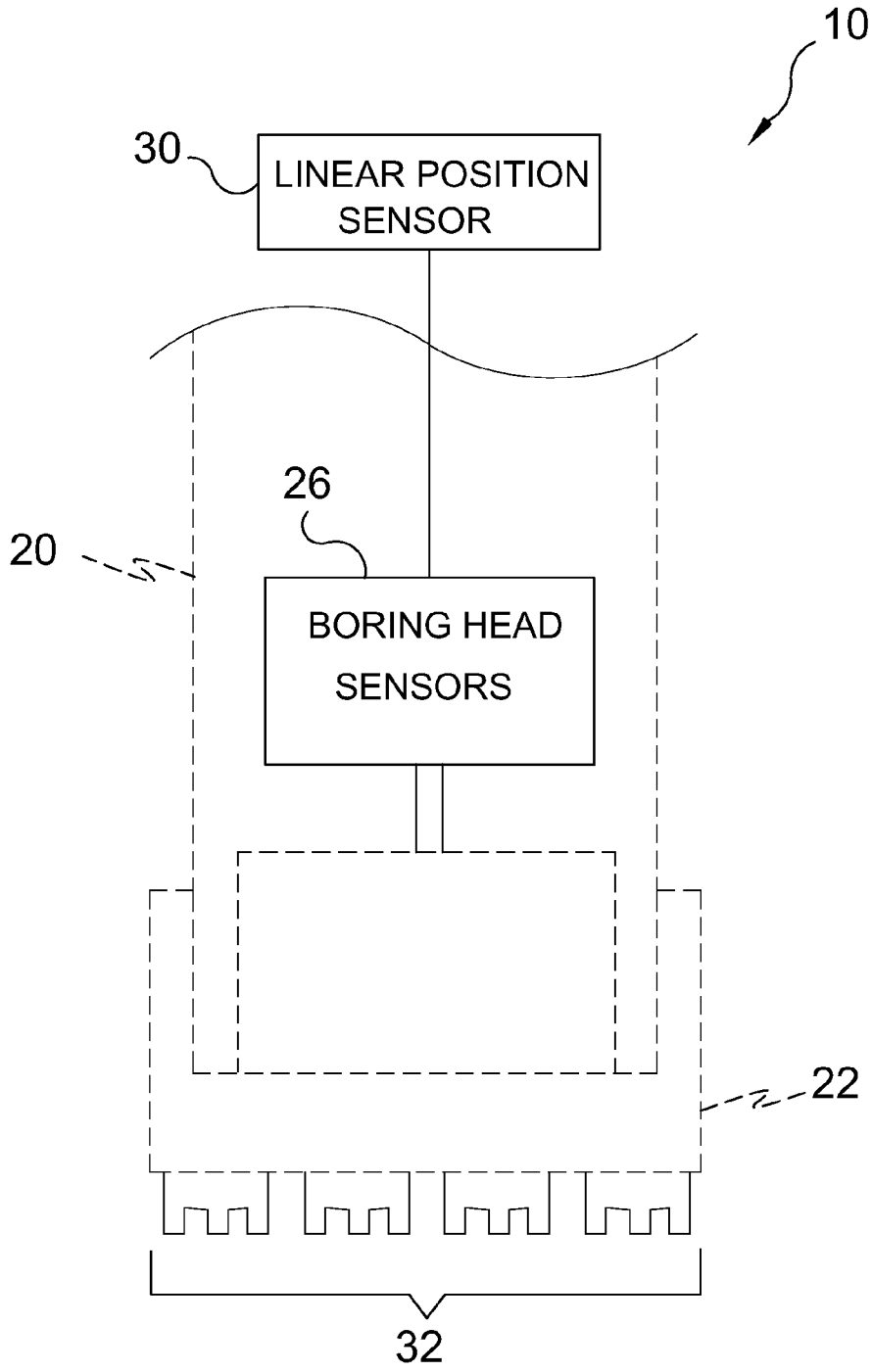
FIG. 2 is an orthographic view of the present invention.

Referring to FIG. 2, shown is an orthographic view of the present invention. Illustrated is the bore head 22 having a linear position sensor 30 and bore head proximity sensor(s) 26 that in combination provide real time information to the computer regarding linear movement of the shaft 20 and bore head 22; this linear movement is used to determine total movement of the bore head 22 and to calculate linear velocity of the bore head 22, and correspondingly, the drills 32 on the bore head 22 which do the actual boring. The number of sensors 26 in the bore head 22 can depend on the bore head 22 size and resolution of sensing needed for boring operations. The linear position sensor 30 can be affixed to either the bore head 22 or the shaft 20, with the programmable logic computer controlling rotational and longitudinal movement of the bore head 22 in response to the data generated from the linear position sensor 30.

Figure 3:
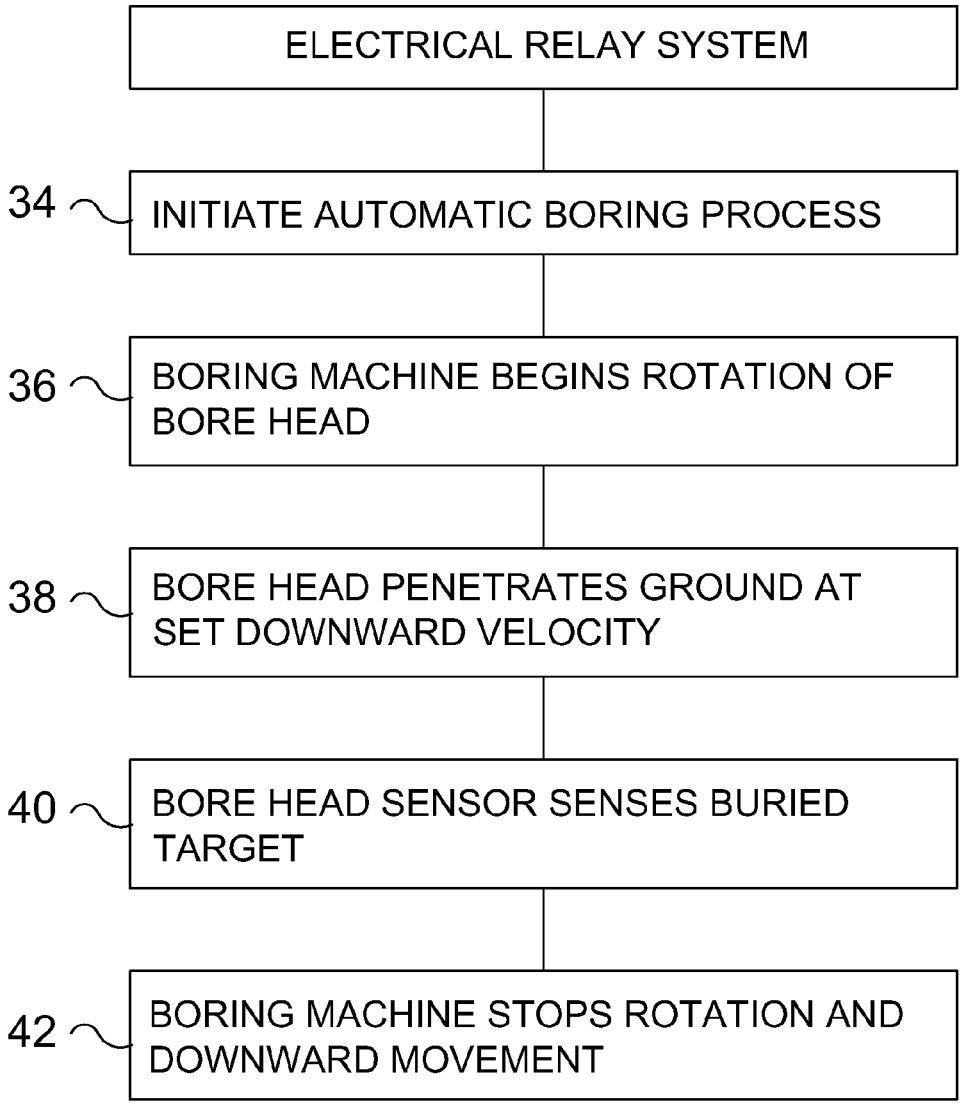
FIG. 3 is a flow chart of the boring operation of the present invention for an electrical relay system.

Referring to FIG. 3, shown is a flow chart of the boring operation of the present invention for an electrical relay system. Shown is a flow chart of the operational characteristics for an electrical relay system when locating a target. After initiating the automatic boring process 34, the boring machine begins rotation of the bore head 36 and penetrates ground at a predetermined velocity 38. When the bore head senses a buried target 40, the boring machine stops rotation and downward movement 42.

Figure 4:
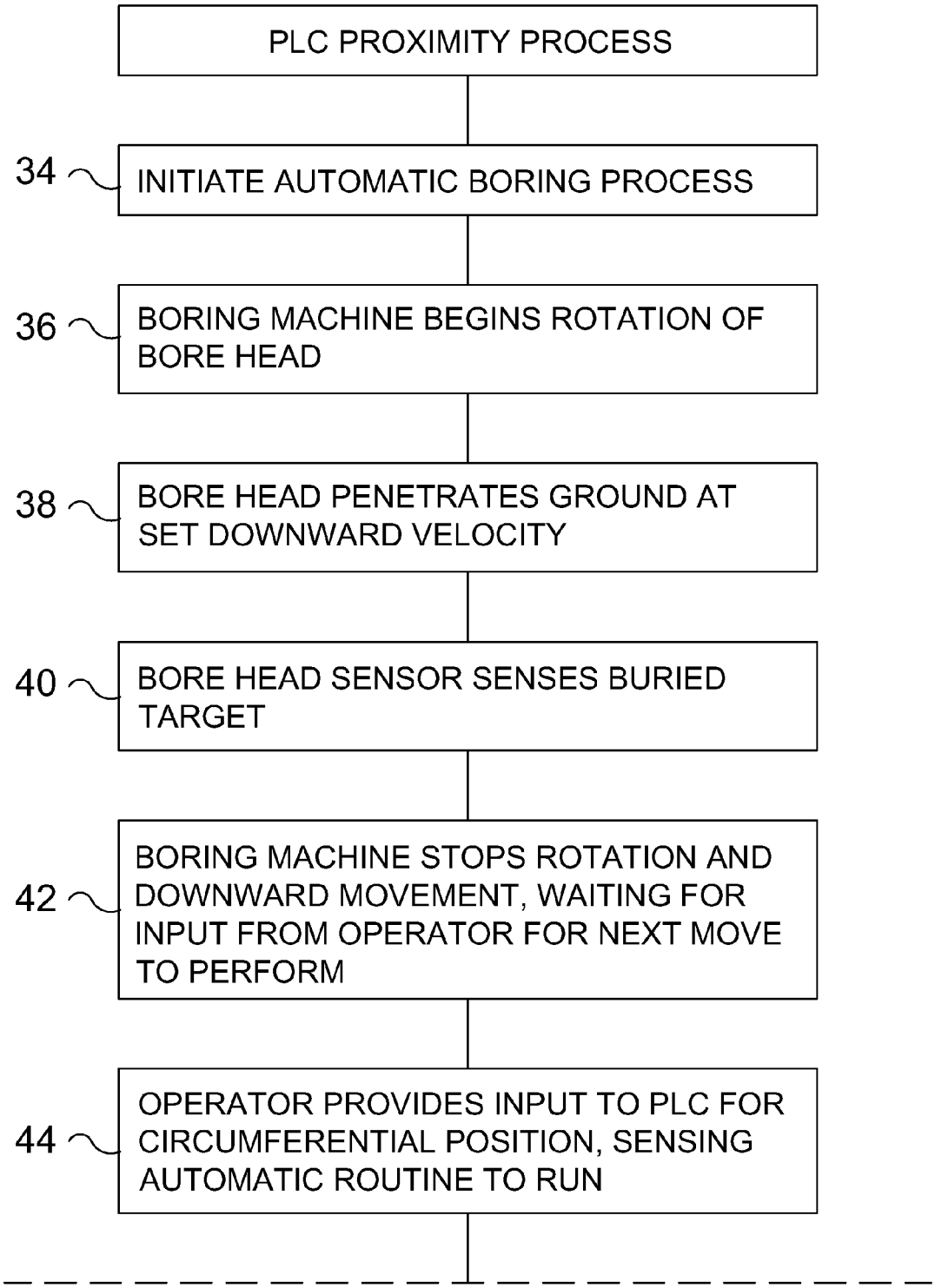
FIG. 4 is a flow chart of the boring operation of the present invention incorporating an automatic positioning process.

Referring to FIG. 4, shown is a flow chart of the boring operation of the present invention incorporating an automatic positioning process. Shown is a flow chart of the operational characteristics locating a target using the computerized boring system of the present invention. After initiating the automatic boring process 34, the boring machine begins rotation of the bore head 36 and penetrates ground at a predetermined velocity 38. When the bore head senses a buried target 40, the boring machine stops rotation and downward movement, waiting for input from the machine operator for the next move to perform 42. The machine operator then provides input to the programmable logic computer for circumferential position, sensing an automatic routine to run 44.

Figure 5:
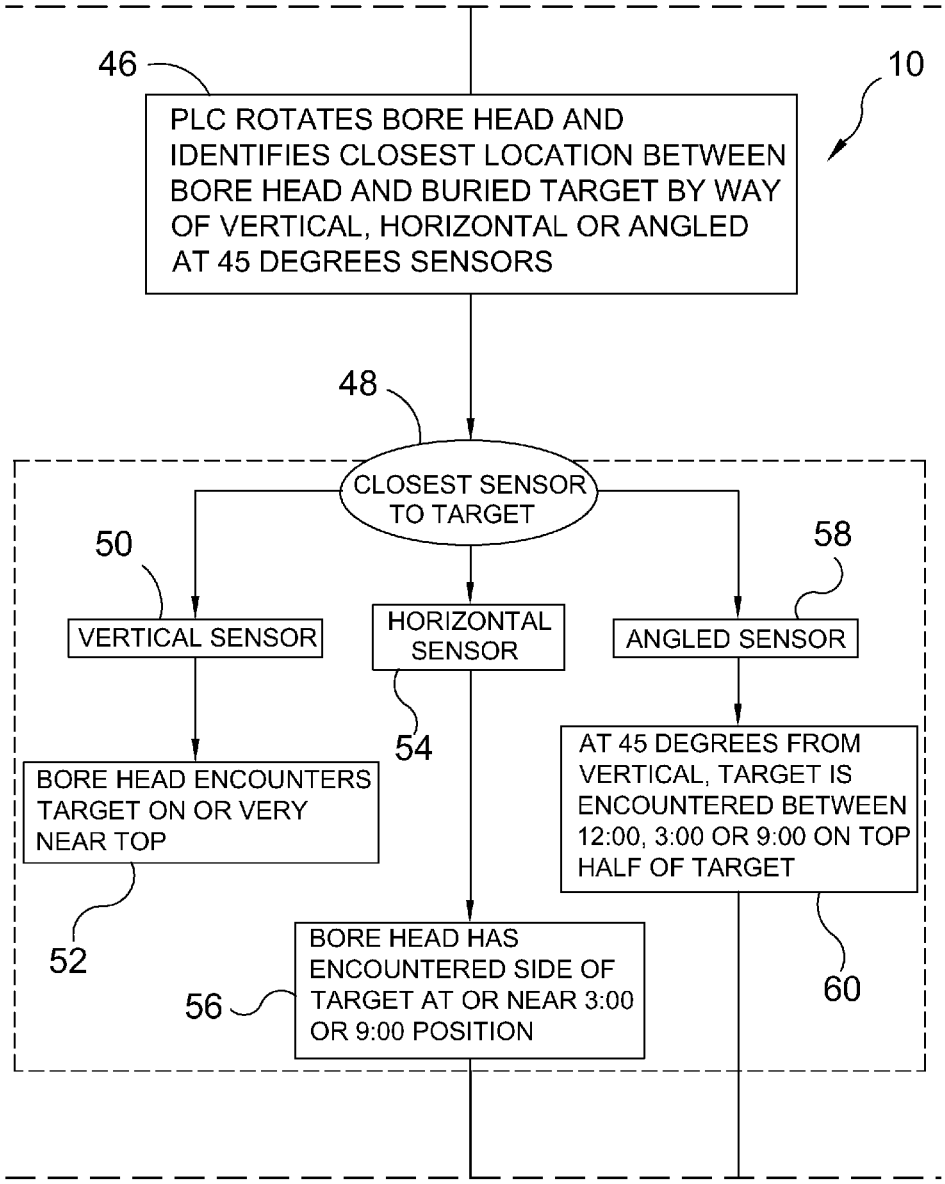
FIG. 5 is a flow chart of the boring operation of the present invention.

Referring to FIG. 5, shown is a flow chart of the boring operation of the present invention, in an embodiment wherein the programmable logic computer includes computational analysis software for determining bore head position relative to a target object's top dead center position. In a preferred embodiment, the bore head includes at least one generally vertical proximity sensor, at least one generally horizontal proximity sensor and at least one proximity sensor angled about 45 degrees between vertical and horizontal. Initially, the programmable logic computer rotates the bore head and identifies the closest location between the bore head and a buried target object with one of the vertical, horizontal or angled at 45 degrees proximity sensors 46, with the position of the closest sensor to the target 48 determining the relative orientation of the sensor and the target. When the vertical sensor 50 is the closest sensor to the target 48, the bore head encounters the target on or very near the top dead center, or 12:00 position, of the target 52. When the horizontal sensor 54 is the closest sensor to the target 48, the bore head encounters the target on or very near one of the two sides of the target, near the 3:00 or 9:00 positions 56. When the angled sensor 58 is the closest sensor to the target 48, the bore head encounters the top half of the target between about the 9:00 position and the 3:00 position of the target 60.

Figure 6:
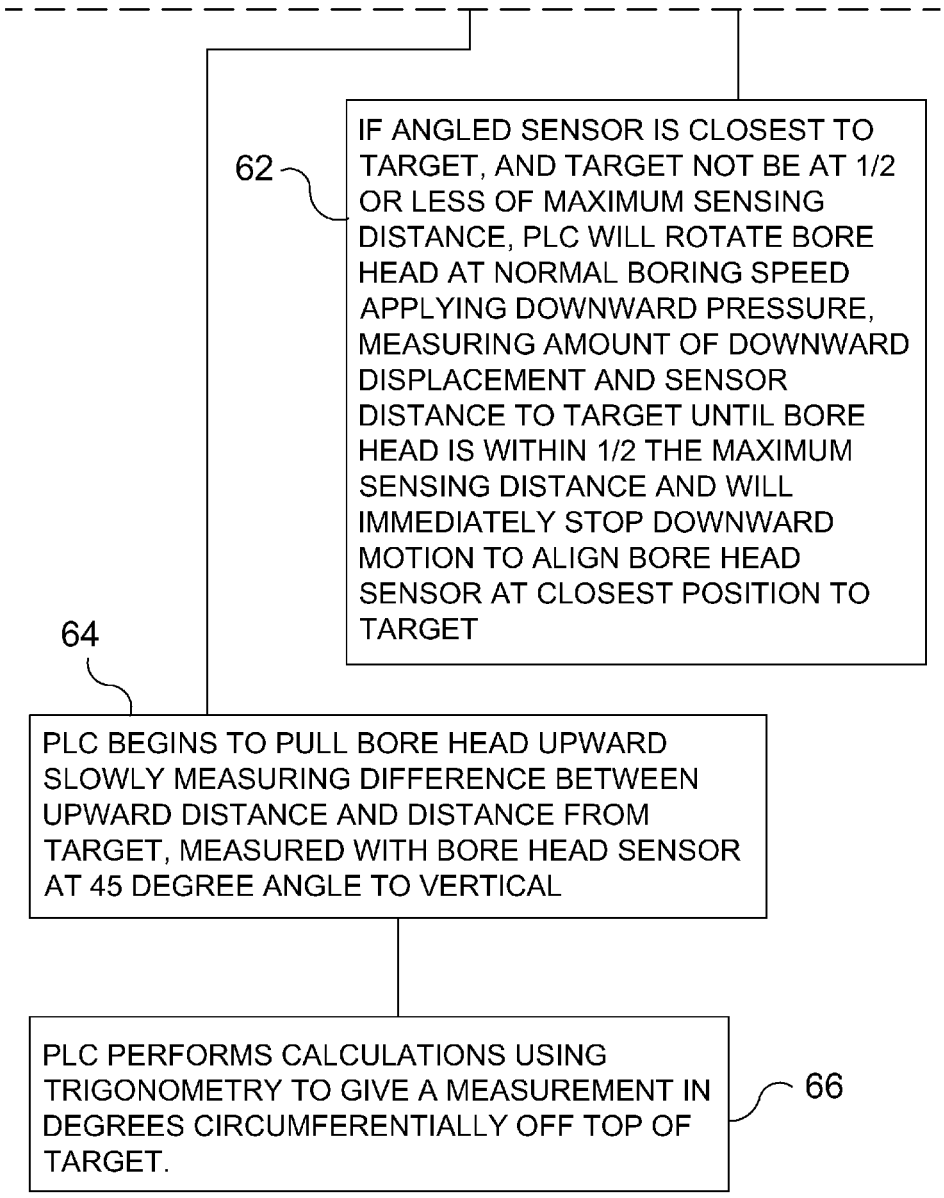
FIG. 6 is a flow chart of the boring operation of the present invention.

Referring to FIG. 6, shown is a flow chart of the boring operation of the present invention. Shown is a flow chart of the operational characteristics locating a target using the computerized boring system of the present invention. If the angled sensor is the sensor closest to the target, and the target is further than ½ the sensor range distant from the sensor, the PLC will rotate the bore head at normal rotating speed while applying downward pressure, measuring the amount of downward displacement and sensor distance to the target until the sensor is within ½ the sensor range at which point the PLC immediately stops downward motion to align the bore head sensor at its closest position to the target 62. The PLC then begins to pull the bore head upward slowly, while measuring the difference between upward distance and distance from target, measured with the angled bore head sensor 64. The PLC then performs calculations using trigonometry to give a measurement in degrees circumferentially off top of target 66.

Figure 7:
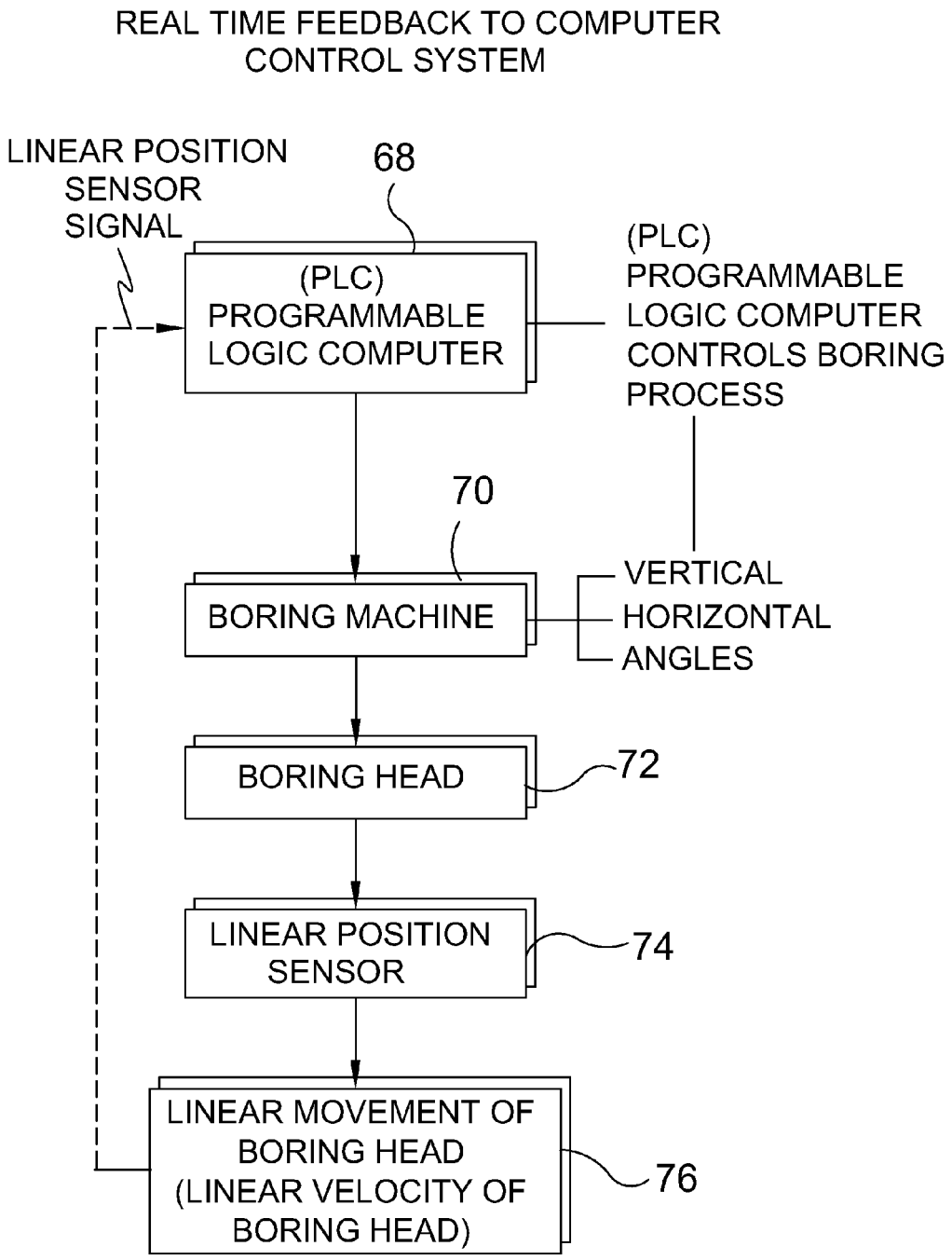
FIG. 7 is a block diagram of an aspect of the present invention.

Referring to FIG. 7, shown is a block diagram of an aspect of the present invention. Shown is a block diagram of real time feedback to the computer control system. The programmable logic computer (PLC) controls the boring process 68 through the boring machine 70, which, in a preferred embodiment, has vertical, horizontal and angled sensors in the boring head 72 along with a linear position sensor 74 which helps determine the linear movement (including velocity) of the boring head 76 by sending a signal to the PLC.

Figure 8:
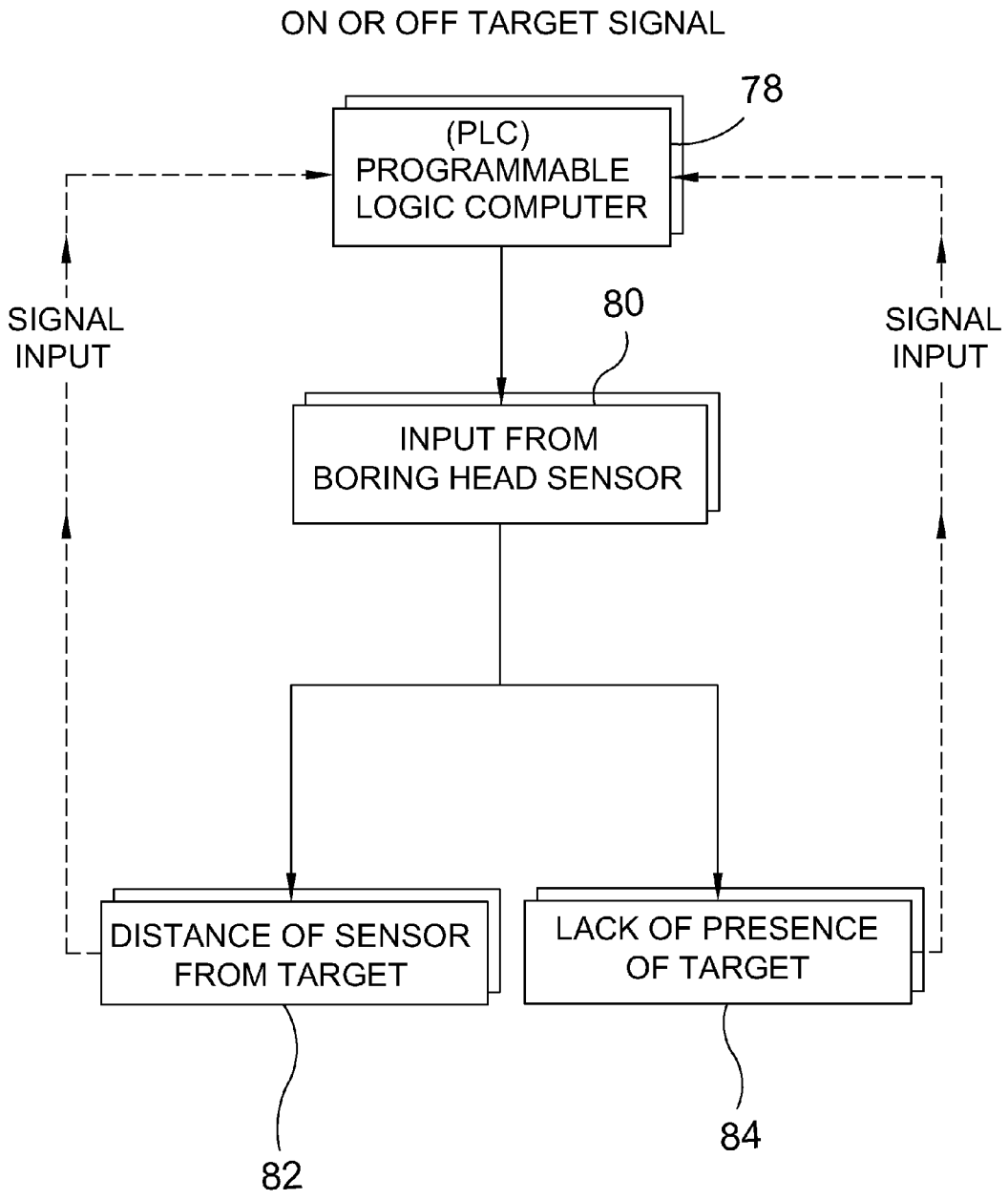
FIG. 8 is a block diagram of another embodiment of the present invention.

Referring to FIG. 8, shown is a block diagram of another aspect of the present invention. Shown is a block diagram of the function on or off target signals. The programmable logic computer 78 receives input from the boring head sensors 80, which send the PLC a signal indicating either the distance from the sensor of a detected target 82 or the absence of a target 84, with an analog signal from the linear position indicator being proportional to the distance of the movement of the sensor.

Figure 9:
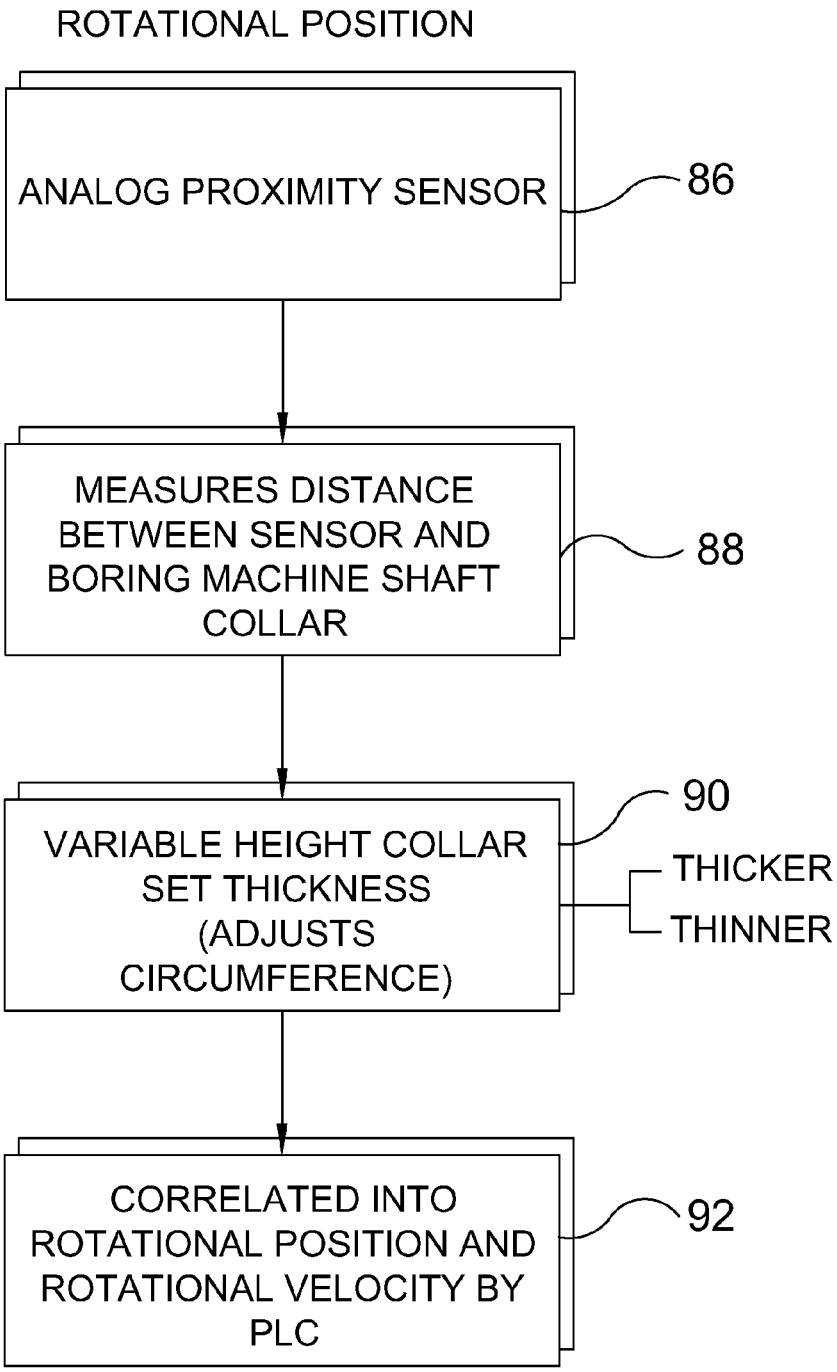
FIG. 9 is a block diagram of another function of the present invention.

Referring to FIG. 9, shown is a block diagram of another function of the present invention. Shown is a block diagram of the means for real time monitoring of the rotational position of the shaft during operation of the computerized boring system of the present invention. A preferred means includes an analog proximity sensor 86 comprising a collar on the shaft, the collar having a circumferentially variable thickness and a collar proximity sensor positioned to measure distance between the collar proximity sensor and an outer surface of the collar 88, the variable thickness of the collar producing pulses 90 by the collar proximity sensor, the pulses correlatable by the programmable logic computer into a rotational position and a rotational velocity of the shaft 92.

Figure 10:
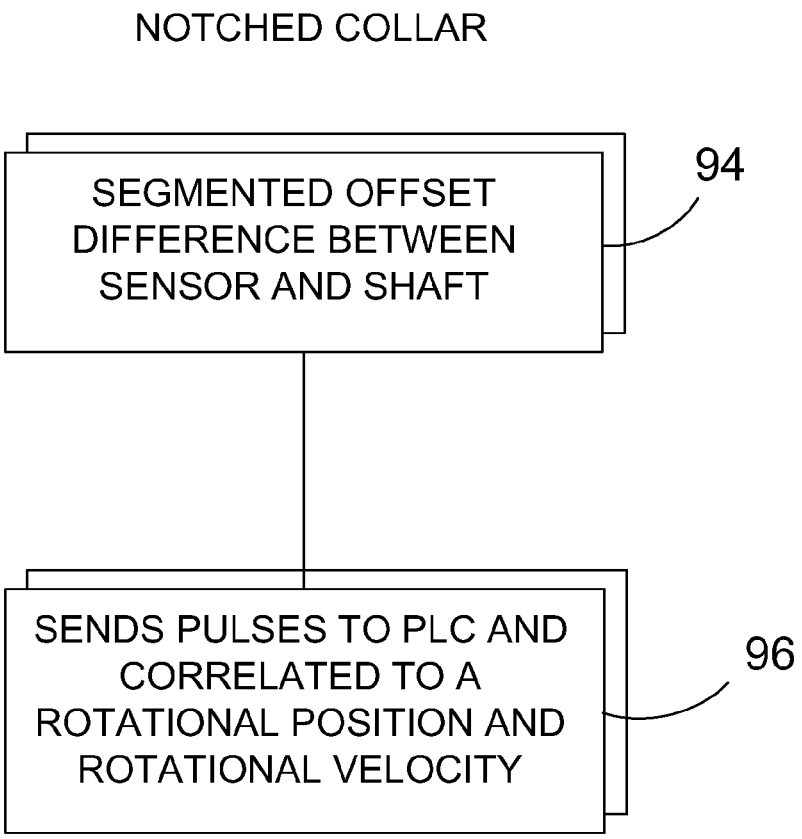
FIG. 10 is a block diagram of another function of the present invention.

Referring to FIG. 10, shown is a block diagram of another function of the present invention. Shown is a block diagram of the notched collar function of the computerized boring system of the present invention wherein the means for real time monitoring of rotational position of the shaft comprises a notched collar on the shaft and a collar proximity sensor positioned to measure distance between the collar proximity sensor and the collar, with the notches in the collar producing pulses by the collar proximity sensor correlated by the programmable logic computer into a rotational position and a rotational velocity of the shaft. The notches in the collar act as a segmented offset difference between the sensor and the shaft 94, with the sensor sending pulses to the PLC which correlates the pulses to a rotational position and rotational velocity 96.

Figure 11:
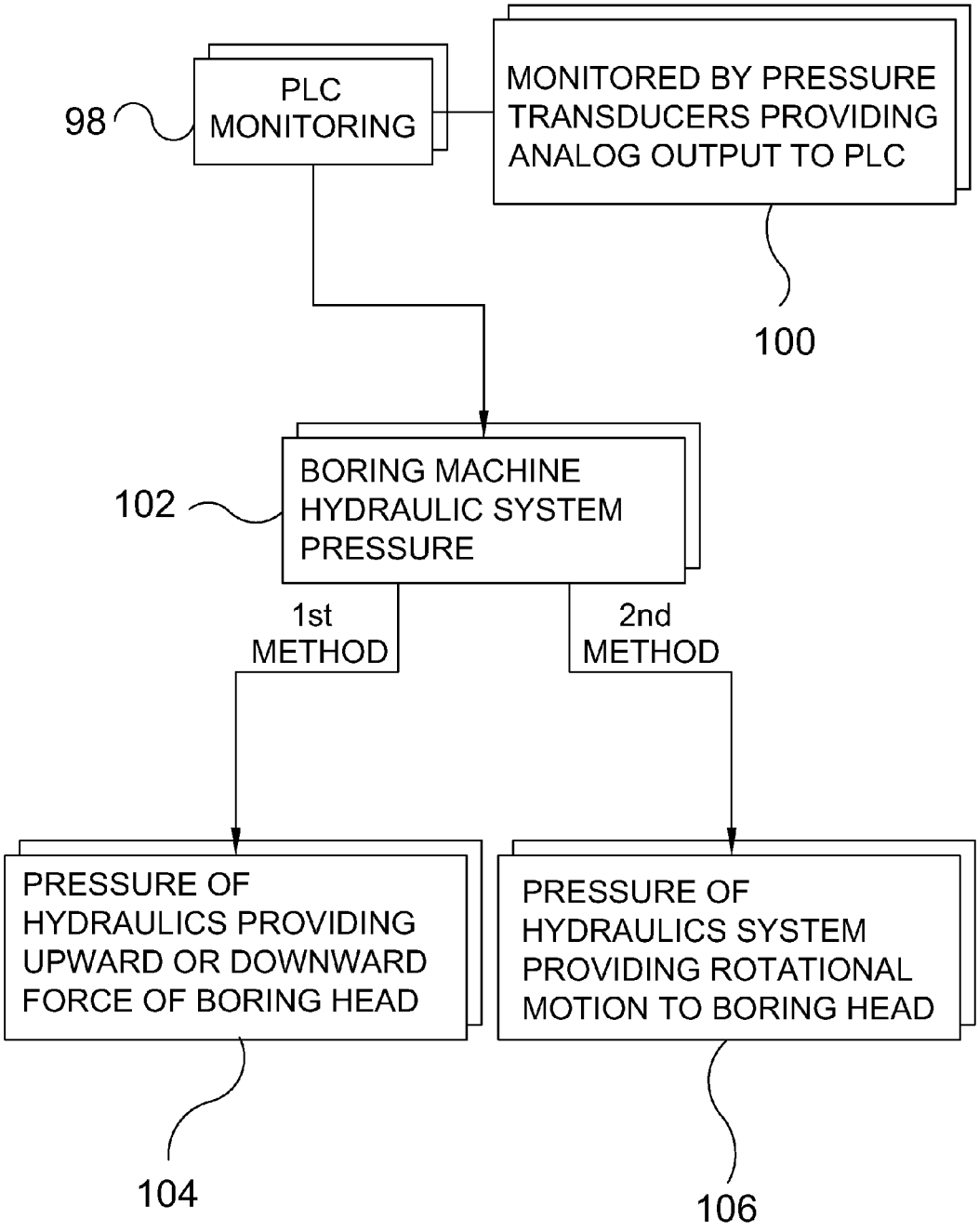
FIG. 11 is a block diagram of another function of the present invention.

Referring to FIG. 11, shown is a block diagram of another function of the present invention. Shown is a block diagram of the PLC monitoring 98, via pressure transducers providing analog output to the PLC 100, and controlling pressure of the boring machine hydraulic systems 102. In a preferred embodiment of the invention the boring machine further includes a longitudinal hydraulic system providing upward and downward force to the shaft 104, a rotational hydraulic system providing rotational motion to the bore head 106, a pressure transducer in each of the longitudinal and rotational hydraulic systems, and one or more electro-hydraulic valves in each of the longitudinal and rotational hydraulic systems, the valves controllable by the programmable logic computer.

Figure 12:
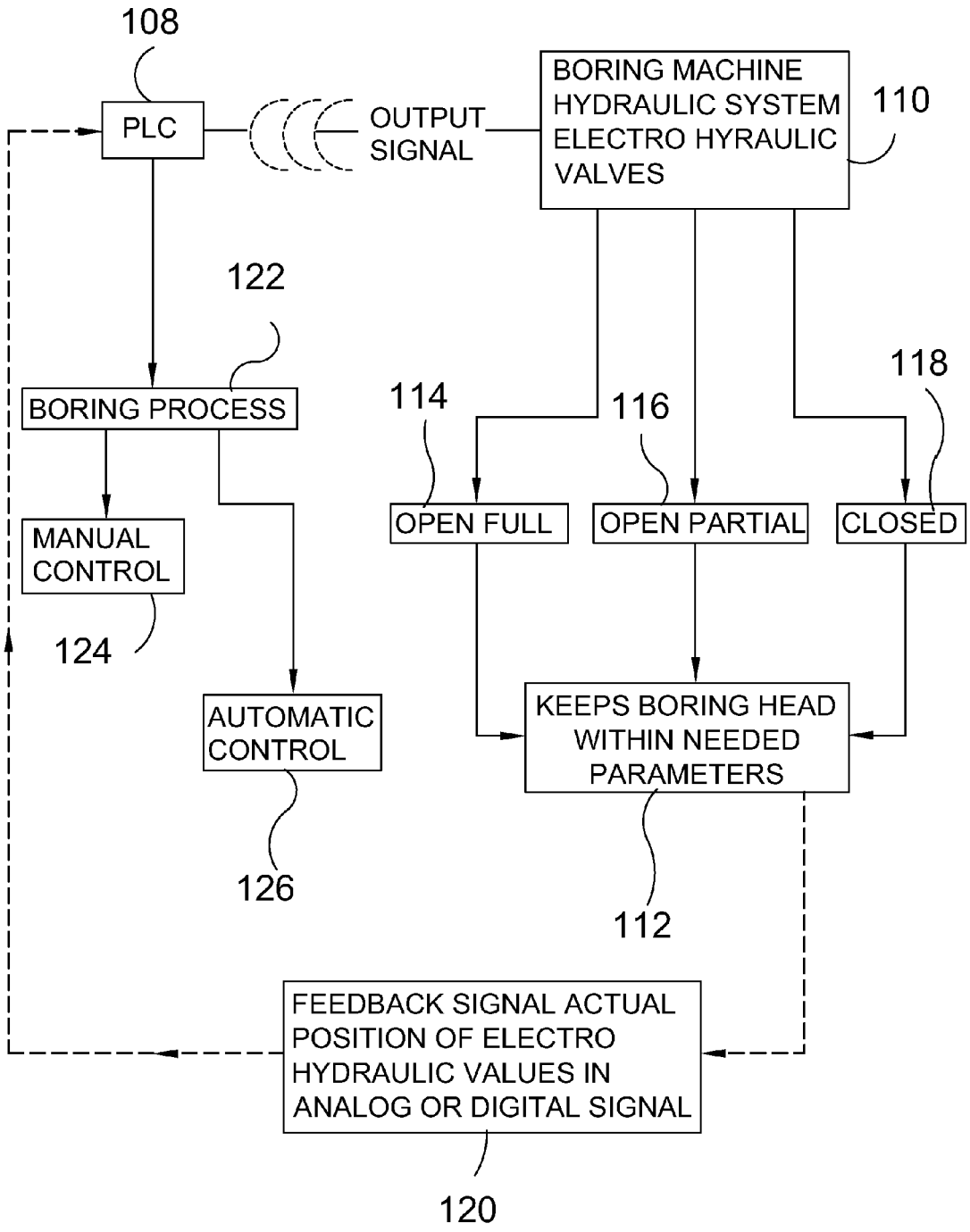
FIG. 12 is a block diagram of the present invention.

Referring to FIG. 12, shown is a block diagram of the present invention. Shown is a block diagram illustrating the PLC 108 monitoring and controlling pressure of the boring machine hydraulic system electro-hydraulic valves 110, the valves controllable by the programmable logic computer 108 to keep the bore head operating within desired parameters 112. The valves can be placed into a fully open position 114, a partially open position 116 or a fully closed position 118. A feedback signal provides the PLC the actual position of the electro-hydraulic valves in an analog or digital signal 120, which is then used to control the boring process 122, either with manual control 124 or automatic control 126. Preferably, the electro-hydraulic valves are located in parallel configuration to manual controls for the boring machine such that the boring machine is controllable both manually by a machine operator and automatically by the programmable logic computer, as necessary.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A computerized boring system comprising:

a) a boring machine having a shaft, a bore head on an end of said shaft, and one or more proximity sensors in said bore head, said one or more proximity sensors for detecting underground target objects;

b) a control system in communication with said one or more sensors for controlling rotational and longitudinal movement of said bore head in response to said one or more sensors;

c) a longitudinal hydraulic system providing upward and downward force to said shaft;

d) a rotational hydraulic system providing rotational motion to said bore head;

e) a pressure transducer in each of said longitudinal and rotational hydraulic systems;

f) one or more electro-hydraulic valves in each of said longitudinal and rotational hydraulic systems, said valves controllable by a programmable logic computer in said control system;

e) said electro-hydraulic valves being located in parallel configuration to manual controls for said boring machine such that said boring machine is controllable both manually by a machine operator and automatically by said programmable logic computer.

2. The computerized boring system according to claim 1, wherein said control system incorporates an electrical relay system in communication with said one or more proximity sensors for controlling said rotational and longitudinal movement of said bore head.

3. The computerized boring system according to claim 2, wherein said one or more proximity sensors are metal detecting proximity sensors.

4. The computerized boring system according to claim 1, further comprising a linear position sensor affixed to one of said shaft and said bore head, with said programmable logic computer controlling rotational and longitudinal movement of said bore head in response to said linear position sensor.

5. The computerized boring system according to claim 1, further comprising an interactive control for executing a boring operation cycle.

6. The computerized boring system according to claim 1, wherein said programmable logic computer comprises computational analysis software for determining bore head position relative to a target object's top dead center position.

7. The computerized boring system according to claim 1, comprising at least one vertical proximity sensor and at least one horizontal proximity sensor.

8. The computerized boring system according to claim 7, further comprising at least one proximity sensor angled intermediately between vertical and horizontal.

9. The computerized boring system according to claim 7, further comprising at least one proximity sensor angled about 45 degrees between vertical and horizontal.

10. A computerized boring system comprising:

a) a boring machine having a shaft, a bore head on an end of said shaft, one or more metal detecting proximity sensors in said bore head for detecting underground target objects, said one or more proximity sensors including at least one vertical proximity sensor, at least one horizontal proximity sensor, and at least one intermediately angled proximity sensor, a linear position sensor affixed to one of said shaft and said bore head, a longitudinal hydraulic system providing upward and downward force to said shaft, a rotational hydraulic system providing rotational motion to said bore head, a pressure transducer in each of said longitudinal and rotational hydraulic systems, and one or more electro-hydraulic valves in each of said longitudinal and rotational hydraulic systems;

b) a computer control system in communication with said one or more proximity sensors, said linear position sensor, and said valves, said computer control system having a programmable logic computer with computational analysis software for determining bore head position relative to a target object's top dead center position and for controlling rotational and longitudinal movement of said bore head by directing opening and closing of said valves in response to signals received from said one or more proximity sensors and said linear position sensor; and c) an interactive control for executing a boring operation cycle, with said electro-hydraulic valves located in parallel configuration to manual controls for said boring machine such that said boring machine is controllable both manually by a machine operator and automatically by said programmable logic computer.

11. The computerized boring system according to claim 10, further comprising means for real time monitoring of rotational position of said shaft comprising:

a) a collar on said shaft, said collar having one of a circumferentially variable thickness and a notched circumference; and b) a collar proximity sensor positioned to measure distance between said collar proximity sensor and an outer surface of said collar, with said collar producing pulses by said collar proximity sensor correlated by said programmable logic computer into a rotational position and a rotational velocity of said shaft.

12. A method of providing real time monitoring and automatic control of a boring operation comprising the steps:

a) providing a computerized boring system having a boring machine with a shaft, a bore head on an end of said shaft, one or more proximity sensors in said bore head for detecting underground target objects, said one or more proximity sensors including at least one vertical proximity sensor, at least one horizontal proximity sensor, and at least one intermediately angled proximity sensor, a linear position sensor affixed to one of said shaft and said bore head, a longitudinal hydraulic system providing upward and downward force to said shaft, a rotational hydraulic system providing rotational motion to said bore head, a pressure transducer in each of said longitudinal and rotational hydraulic systems, and one or more electro-hydraulic valves in each of said longitudinal and rotational hydraulic systems; a computer control system in communication with said one or more proximity sensors, said linear position sensor, and said valves, said computer control system having a programmable logic computer with computational analysis software for determining bore head position relative to a target object and for controlling rotational and longitudinal movement of said bore head by directing opening and closing of said valves in response to signals received from said one or more proximity sensors and said linear position sensor; and an interactive control for executing a boring operation cycle, with said electro-hydraulic valves located in parallel configuration to manual controls for said boring machine such that said boring machine is controllable both manually by a machine operator and automatically by said programmable logic computer;

b) operating said boring machine by actuating said longitudinal and rotational hydraulic systems such that said bore head bores into a ground surface;

c) generating a proximity signal from one of said proximity sensors to said computer control system indicating that a target object has been sensed within a sensor range of said proximity sensor; and d) generating a control signal from said programmable logic computer directing said boring machine to stop longitudinal movement of said bore head after receiving a proximity signal.

13. The method of providing real time monitoring and automatic control of a boring operation according to claim 12, further comprising the step of said programmable logic computer calculating and displaying the position of said proximity sensor relative to the target object.

14. The method of providing real time monitoring and automatic control of a boring operation according to claim 12, further comprising the step of said programmable logic computer prompting, through said interactive control, for manual control by a machine operator subsequent to said stop control signal.

15. The method of providing real time monitoring and automatic control of a boring operation according to claim 12, further comprising the steps:

a) said proximity sensors providing periodic sensor readings with rotation of said bore head;

b) said programmable logic computer calculating a operational rotational speed and longitudinal velocity of said bore head such that, when said boring machine is operating, said bore head travels, between periodic sensor readings, a longitudinal distance less than said sensor range; and c) said programmable logic computer controlling, through directing opening and closing of said valves, said boring machine at said operational rotational speed and longitudinal velocity of said bore head.

16. The method of providing real time monitoring and automatic control of a boring operation according to claim 12, further comprising the steps:

a) providing a collar on said shaft, said collar having one of a circumferentially variable thickness and a notched circumference;

b) providing a collar proximity sensor positioned to measure distance between said collar proximity sensor and an outer surface of said collar, with said collar producing pulses by said collar proximity sensor;

c) transmitting said pulses to said programmable logic computer; and d) said programmable logic computer correlating said pulses into a rotational position and a rotational velocity of said shaft.

17. A computerized boring system comprising:

a) a boring machine having a shaft, a bore head on an end of said shaft, and one or more proximity sensors in said bore head, said one or more proximity sensors for detecting underground target objects;

b) a control system in communication with said one or more sensors for controlling rotational and longitudinal movement of said bore head in response to said one or more sensors; and c) means for real time monitoring of rotational position of said shaft comprising:

i) a collar on said shaft, said collar having a circumferentially variable thickness; and ii) a collar proximity sensor positioned to measure distance between said collar proximity sensor and an outer surface of said collar, with said variable thickness of said collar producing pulses by said collar proximity sensor correlated by said programmable logic computer into a rotational position and a rotational velocity of said shaft.

18. A computerized boring system comprising:

a) a boring machine having a shaft, a bore head on an end of said shaft, and one or more proximity sensors in said bore head, said one or more proximity sensors for detecting underground target objects; and b) a control system in communication with said one or more sensors for controlling rotational and longitudinal movement of said bore head in response to said one or more sensors.

c) means for real time monitoring of rotational position of said shaft comprising:

i) a notched collar on said shaft; and ii) a collar proximity sensor positioned to measure distance between said collar proximity sensor and said collar, with said notches in said collar producing pulses by said collar proximity sensor correlated by said programmable logic computer into a rotational position and a rotational velocity of said shaft.

* * * * *